US012241646B2

(12) United States Patent
Li

(10) Patent No.: US 12,241,646 B2
(45) Date of Patent: Mar. 4, 2025

(54) AIR CONDITIONER CONTROL METHOD AND APPARATUS, AND COMPUTER-READABLE STORAGE MEDIUM

(71) Applicants: Shanghai Meicon Intelligent Construction Co., Ltd., Shanghai (CN); GD Midea Heating & Ventilating Equipment Co., Ltd., Foshan (CN)

(72) Inventor: Yuanyang Li, Shanghai (CN)

(73) Assignees: SHANGHAI MEICON INTELLIGENT CONSTRUCTION CO., LTD., Shanghai (CN); GD MIDEA HEATING & VENTILATING EQUIPMENT CO., LTD., Foshan (CN)

( * ) Notice: Subject to any disclaimer, the term of this patent is extended or adjusted under 35 U.S.C. 154(b) by 466 days.

(21) Appl. No.: 17/579,507

(22) Filed: Jan. 19, 2022

(65) Prior Publication Data

US 2022/0136725 A1 May 5, 2022

Related U.S. Application Data

(63) Continuation of application No. PCT/CN2020/077167, filed on Feb. 28, 2020.

(30) Foreign Application Priority Data

Oct. 16, 2019 (CN) ..... 201910986944.3

(51) Int. Cl.
*F24F 11/48* (2018.01)
*F24F 11/46* (2018.01)
(Continued)

(52) U.S. Cl.
CPC ..... *F24F 11/48* (2018.01); *F24F 11/46* (2018.01); *F24F 11/61* (2018.01);
(Continued)

(58) Field of Classification Search
None
See application file for complete search history.

(56) References Cited

U.S. PATENT DOCUMENTS 9,471,946 B1 * 10/2016 Keil ..... F24F 11/32
9,639,096 B2 * 5/2017 Miwa ..... F24F 11/62
(Continued)

FOREIGN PATENT DOCUMENTS

CN 101424436 A 5/2009
CN 101650552 A * 2/2010
(Continued)

OTHER PUBLICATIONS

Guangdong Meidi Heating Ventilation Equipment Co., Ltd., First Office Action, CN Application No. 2019109869443.3, May 29, 2020, 6 pgs.

(Continued)

*Primary Examiner* — Jason Lin
(74) *Attorney, Agent, or Firm* — Morgan, Lewis & Bockius LLP

(57) ABSTRACT

An air conditioner control method and apparatus, and a computer-readable storage medium. The air conditioner control method includes: determining whether a time interval between the current moment and a preset moment at which work is started is less than or equal to the maximum early start duration; if the time interval is less than or equal to the maximum early start duration, acquiring a preliminary demand load corresponding to a central air-conditioner, and acquiring a startup combination load corresponding to the central air-conditioner; and based on the startup combination
(Continued)

load and the preliminary demand load, determining a start moment of a host to be started.

13 Claims, 1 Drawing Sheet

(51) Int. Cl.
*F24F 11/61* (2018.01)
*F24F 110/12* (2018.01)
*F24F 140/20* (2018.01)
*F24F 140/50* (2018.01)

(52) U.S. Cl.
CPC ..... *F24F 2110/12* (2018.01); *F24F 2140/20* (2018.01); *F24F 2140/50* (2018.01)

(56) References Cited

U.S. PATENT DOCUMENTS

| | | | | |
|---|---|---|---|---|
| 9,719,714 | B2 * | 8/2017 | Kim | F25D 17/042 |
| 9,970,671 | B2 * | 5/2018 | Bailey | F24F 11/70 |
| 9,982,903 | B1 * | 5/2018 | Ridder | F24F 11/70 |
| 10,605,477 | B2 * | 3/2020 | Ridder | F24F 11/84 |
| 11,079,131 | B2 * | 8/2021 | Konno | F24F 11/61 |
| 2011/0144948 | A1 * | 6/2011 | Nishino | F24F 11/38 702/183 |
| 2012/0042672 | A1 * | 2/2012 | Fujihara | F24F 3/14 62/157 |
| 2012/0296480 | A1 | 11/2012 | Raman | |
| 2015/0156031 | A1 * | 6/2015 | Fadell | G08B 27/003 700/90 |

FOREIGN PATENT DOCUMENTS

| | | | | | |
|---|---|---|---|---|---|
| CN | 103335377 | A | | 10/2013 | |
| CN | 103940058 | A | | 7/2014 | |
| CN | 106091247 | A | | 11/2016 | |
| CN | 106225172 | A | * | 12/2016 | |
| CN | 205980188 | U | | 2/2017 | |
| CN | 108168052 | A | | 6/2018 | |
| CN | 108270649 | A | | 7/2018 | |
| CN | 108444077 | A | * | 8/2018 | |
| CN | 108917103 | A | | 11/2018 | |
| CN | 108954713 | A | | 12/2018 | |
| CN | 108990383 | A | * | 12/2018 | H05K 7/20827 |
| CN | 109357368 | A | | 2/2019 | |
| CN | 109373539 | A | | 2/2019 | |
| CN | 109708258 | A | | 5/2019 | |
| CN | 109812949 | A | * | 5/2019 | |
| CN | 109855244 | A | | 6/2019 | |
| CN | 110232503 | A | | 9/2019 | |
| CN | 110319540 | A | | 10/2019 | |
| CN | 110686382 | A | | 1/2020 | |
| EP | 3012546 | A1 | | 4/2016 | |
| EP | 3107173 | A1 | | 12/2016 | |
| JP | S5835347 | A | | 3/1983 | |
| JP | H05233012 | A | | 9/1993 | |
| JP | 2005241033 | A | | 9/2005 | |
| KR | 100784994 | B1 | | 12/2007 | |

OTHER PUBLICATIONS

Guangdong Midea HVAC Equipment Co., Ltd., Midea Group Co., Ltd., Notice of Allowance, CN Application No. 201910986944.3, Jan. 8, 2021, 6 pgs.
Guangdong Midea HVAC Equipment, Co., Ltd., International Search Report, PCT/CN2020/077167, Jun. 1, 2020, 12 pgs.
Midea Group Co., Ltd., European Office Action, EP 20876505.7, Oct. 11, 2023, 4 pgs.
Midea Group Co., Ltd., Extended European Search Report, EP 20876505.7, Jul. 22, 2022, 8 pgs.
Midea Group Co., Ltd., Written Opinion, PCT/CN2020/077167, Jun. 11, 2020, 6 pgs.
Midea Group Co., Ltd., IPRP, PCT/CN2020/077167, Apr. 19, 2022, 7 pgs.

* cited by examiner

AIR CONDITIONER CONTROL METHOD AND APPARATUS, AND COMPUTER-READABLE STORAGE MEDIUM

CROSS-REFERENCE TO RELATED APPLICATION

This application is a continuation of PCT International Application No. PCT/CN2020/077167, filed Feb. 28, 2020 entitled "Air conditioner control method and apparatus, and computer readable storage medium," the entire content of which is incorporated herein by reference, which claims priority to and the benefit of the Chinese Patent Application No. 201910986944.3 filed on Oct. 16, 2019, the entire contents of which are incorporated herein by reference.

FIELD

The present disclosure relates to the field of the air conditioner technology, in particular to an air conditioner control method and apparatus, and a computer-readable storage medium.

BACKGROUND

At present, a central air conditioner for most public buildings (especially large buildings such as office, hotel, shopping mall, and stadium) needs to be pre-cooled or pre-heated before work is started, so that indoor air meets set requirements on temperature and humidity at the moment when work is started. A pre-cooling or pre-heating period refers to a time period ahead of startup of the central air conditioner to allow the system to enter a normal operation status, when the moment when work is started is reached, for providing comfortable indoor environment.

The engineering experience value as to a preparatory period for an air conditioner system is half an hour or one hour. However, this preparatory period for an actually-used air conditioner system varies depending on changes of cooling consumption by the previous day, as well as an outdoor weather and an indoor heat source between yesterday and today, rather than being fixed. Sometimes, it does not take such a long period to reach the set temperature, while there is still a long time left before the moment when work is actually started. Accordingly, the central air condition has to keep operation in order to maintain the indoor temperature, resulting in waste of energy, and even causing the indoor temperature exceeding the set requirement on comfortable temperature. On the other hand, a short preparatory period for the air conditioner system although reduces energy consumption, leads to unmet design requirements on the indoor temperature and humidity, thus inducing complaints about the property management due to unsatisfactory comfortability during work time.

The above content only assists to understand the technical solutions of present disclosure, but does not mean to acknowledge the above content as prior art.

SUMMARY

The main objective of the present disclosure is to provide an air conditioner control method and apparatus, and a computer-readable storage medium, aiming to solve the technical problem of inaccurate pre-cooling or pre-heating of the existing central air conditioner.

In order to achieve the above objective, the present disclosure provides an air conditioner control method, applied in a central air conditioner. The air conditioner control method includes the following steps:

determining whether a time interval between a current moment and a preset moment at which work is started is less than or equal to a maximum early start duration;

acquiring a preparatory demand load corresponding to the central air conditioner and acquiring a startup combination load corresponding to the central air conditioner, if the time interval is less than or equal to the maximum early start duration; and determining a start moment of a host to be started on a basis of the startup combination load and the preparatory demand load.

In some embodiments, the step of acquiring a preparatory demand load corresponding to the central air conditioner includes:

acquiring an outdoor wet-bulb temperature, an indoor temperature and a return water temperature corresponding to the central air conditioner; and determining the preparatory demand load based on an indoor set temperature corresponding to the central air conditioner, the outdoor wet-bulb temperature, the indoor temperature and the return water temperature.

In some embodiments, the step of acquiring a startup combination load corresponding to the central air conditioner includes:

determining the host to be started corresponding to the central air conditioner based on the preparatory demand load; and determining the startup combination load based on the host to be started.

In some embodiments, the step of determining the startup combination load based on the host to be started includes:

acquiring an outlet water temperature corresponding to the host to be started; and determining the startup combination load based on an operation parameter of the host to be started, the outlet water temperature and the outdoor wet-bulb temperature.

In some embodiments, the step of determining a start moment of a host to be started on a basis of the startup combination load and the preparatory demand load includes:

calculating a start operation duration based on the startup combination load and the preparatory demand load; and determining the start moment of the host to be started based on the start operation duration.

In some embodiments, the air conditioner control method further includes:

acquiring a predicted load of the central air conditioner at the current moment, when a startup instruction or a shutdown instruction corresponding to an indoor unit in the central air conditioner is detected;

determining whether the predicted load meets a change condition for an outdoor unit; and adjusting an operating status of the outdoor unit in the central air conditioner based on the predicted load, if the predicted load meets the change condition for the outdoor unit.

In some embodiments, the step of acquiring a predicted load of the central air conditioner at the current moment includes:

acquiring an operation parameter corresponding to the indoor unit that is currently in the startup status in the central air conditioner, the operation parameter including a rated cooling capacity of the indoor unit;

determining a first total cooling capacity corresponding to the indoor units that are currently in the startup status based on the operation parameter;

acquiring a second gross cooling capacity of all indoor units in the central air conditioner;

determining a terminal startup ratio based on the first total cooling capacity and the second gross cooling capacity; and determining the predicted load based on the terminal startup ratio and a preset gross load corresponding to the central air conditioner.

In some embodiments, after the step of determining a start moment of a host to be started on a basis of the startup combination load and the preparatory demand load, the air conditioner control method further includes:

starting the host to be started and the indoor unit corresponding to the preset moment at which work is started, when the current moment reaches the start moment.

Besides, in order to achieve the above objective, the present disclosure provides an air conditioner control apparatus, applied in a central air conditioner. The air conditioner control apparatus includes: a memory, a processor, and an air conditioner control program stored in the memory and executable by the processor, wherein the air conditioner control program when executed by the processor implements steps of an air conditioner control method as described above.

In addition, in order to achieve the above objective, the present disclosure provides a computer-readable storage medium having stored therein an air conditioner control program that, when executed by a processor, implements steps of an air conditioner control method as described above.

The present disclosure determines whether the time interval between the current moment and the preset moment at which work is started is less than or equal to the maximum early start duration; acquires the preparatory demand load corresponding to the central air conditioner and acquires the startup combination load corresponding to the central air conditioner, if the time interval is less than or equal to the maximum early start duration; and determines the start moment of the host to be started on the basis of the startup combination load and the preparatory demand load, such that the start moment of the host in the central air conditioner can be determined according to the preparatory demand load, which is convenient for subsequent starting the central air conditioner in advance according to the start moment, thus reducing energy consumption and guaranteeing comfortability in rooms corresponding to the moment at which work is started, so that the accuracy of precooling or preheating by the central air conditioner is improved.

The implementation, functional characteristics and advantages of the objective of the present disclosure will be further illustrated in conjunction with the embodiments and with reference to the accompanying drawings.

DETAILED DESCRIPTION

It should be understood that the specific embodiments described here only intend to explain the present disclosure, but are not construed to limit the present disclosure.

Figure 1:
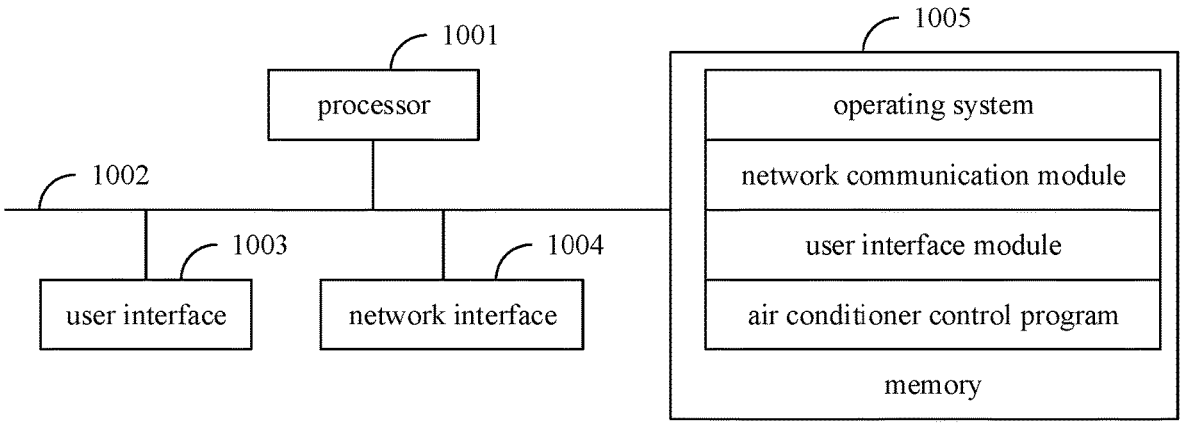
FIG. 1 is a schematic structural diagram showing an air conditioner control apparatus in a hardware operating environment according to some embodiments of the present disclosure.

As shown in FIG. 1, FIG. 1 is a schematic structural diagram showing an air conditioner control apparatus in a hardware operating environment according to some embodiments of the present disclosure.

As shown in FIG. 1, the air conditioner control apparatus may include: a processor 1001 (for example, a central processor unit, CPU), a network interface 1004, a user interface 1003, a memory 1005, and a communication bus 1002. The communication bus 1002 is configured to implement connection communication between these components. The user interface 1003 may include a display, an input unit like a keyboard. The user interface 1003 may alternatively include a standard wired interface and wireless interface. The network interface 1004 may include a standard wired interface and wireless interface (such as a wireless fidelity (Wi-Fi) interface). The memory 1005 may be a high-speed random-access memory (RAM), or a non-volatile memory, such as a magnetic disk memory. The memory 1005 may also be a storage device independent of the aforementioned processor 1001.

In some embodiments, the air conditioner control apparatus may also include a camera, a radio frequency (RF) circuit, a sensor, an audio circuit, a Wi-Fi module, and so on.

Those skilled in the art can understand that the structure of the air conditioner control apparatus shown in FIG. 1 does not construe to limit the air conditioner control apparatus, but may include more or fewer components than those shown in the FIG. 1, or a combination of certain components, or different configuration of the components.

As shown in FIG. 1, as a computer storage medium, the memory 1005 may include an operating system, a network communication module, a user interface module, and an air conditioner control program.

In the air conditioner control apparatus shown in FIG. 1, the network interface 1004 is mainly used to connect to a back-end server and communicate with the back-end server; the user interface 1003 is mainly used to connect to a client-side (a user-side) and communicate with the client-side; and the processor 1001 may be used to call the air conditioner control program stored in the memory 1005.

In these embodiments, the air conditioner control apparatus includes: a memory 1005, a processor 1001, and an air conditioner control program stored in the memory 1005 and executable by the processor 1001. The processor 1001 calls the air conditioner control program stored in the memory 1005 to implement the following steps:

determining whether a time interval between a current moment and a preset moment at which work is started is less than or equal to a maximum early start duration;

acquiring a preparatory demand load corresponding to a central air conditioner and acquiring a startup combination load corresponding to the central air conditioner, if the time interval is less than or equal to the maximum early start duration; and determining a start moment of a host to be started on a basis of the startup combination load and the preparatory demand load.

In some examples, the processor 1001 may call the air conditioner control program stored in the memory 1005 to implement the following steps:

acquiring an outdoor wet-bulb temperature, an indoor temperature and a return water temperature corresponding to the central air conditioner; and determining the preparatory demand load based on an indoor set temperature corresponding to the central air conditioner, the outdoor wet-bulb temperature, the indoor temperature and the return water temperature.

In some examples, the processor 1001 may call the air conditioner control program stored in the memory 1005 to implement the following steps:

determining the host to be started corresponding to the central air conditioner based on the preparatory demand load; and determining the startup combination load based on the host to be started.

In some examples, the processor 1001 may call the air conditioner control program stored in the memory 1005 to implement the following steps:

acquiring an outlet water temperature corresponding to the host to be started; and determining the startup combination load based on an operation parameter of the host to be started, the outlet water temperature and the outdoor wet-bulb temperature.

In some examples, the processor 1001 may call the air conditioner control program stored in the memory 1005 to implement the following steps:

calculating a start operation duration based on the startup combination load and the preparatory demand load; and determining the start moment of the host to be started based on the start operation duration.

In some examples, the processor 1001 may call the air conditioner control program stored in the memory 1005 to implement the following steps:

acquiring a predicted load of the central air conditioner at the current moment, when a startup instruction or a shutdown instruction corresponding to an indoor unit in the central air conditioner is detected;

determining whether the predicted load meets a change condition for an outdoor unit; and adjusting an operating status of the outdoor unit in the central air conditioner based on the predicted load, if the predicted load meets the change condition for the outdoor unit.

In some examples, the processor 1001 may call the air conditioner control program stored in the memory 1005 to implement the following steps:

acquiring an operation parameter corresponding to the indoor unit that is currently in the startup status in the central air conditioner, the operation parameter including a rated cooling capacity of the indoor unit;

determining a first total cooling capacity corresponding to the indoor units that are currently in the startup status based on the operation parameter;

acquiring a second gross cooling capacity of all indoor units in the central air conditioner;

determining a terminal startup ratio based on the first total cooling capacity and the second gross cooling capacity; and determining the predicted load based on the terminal startup ratio and a preset gross load corresponding to the central air conditioner.

In some examples, the processor 1001 may call the air conditioner control program stored in the memory 1005 to implement the following steps:

starting the host to be started and the indoor unit corresponding to the preset moment at which work is started, when the current moment reaches the start moment.

Figure 2:
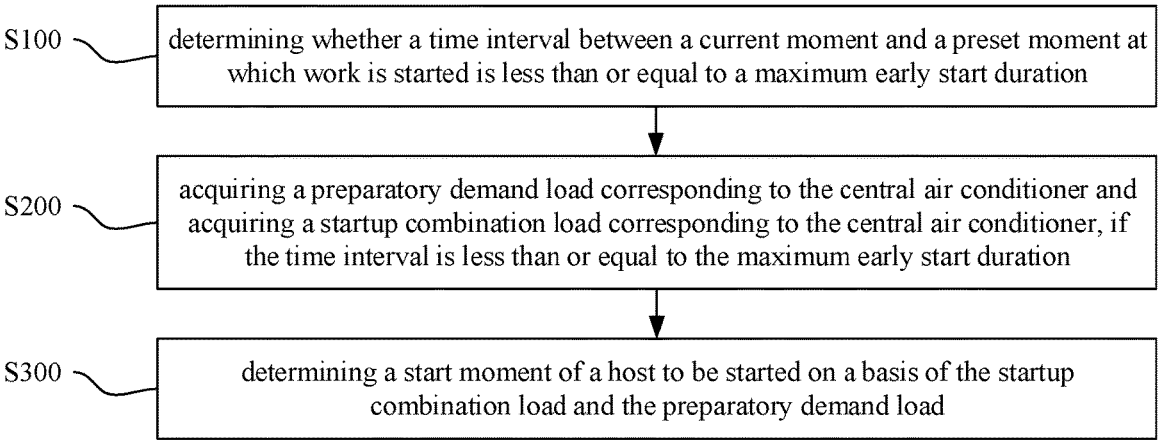
FIG. 2 is a flow chart showing an air conditioner control method according to some first embodiments of the present disclosure.

The present disclosure further provides an air conditioner control method, referring to FIG. 2, which is a flow chart showing an air conditioner control method according to some first embodiments of the present disclosure.

In embodiments of the present disclosure, the central air conditioner may be applied in office buildings, administration buildings, commercial buildings and other scenarios. The central air conditioner is equipped with a plurality of hosts (outdoor units).

In these embodiment, the air conditioner control method is applied in a central air conditioner and includes the following steps of S100 to S300.

At the step of S100, it is determined whether a time interval between a current moment and a preset moment at which work is started is less than or equal to a maximum early start duration.

In these embodiments, when the central air conditioner is in a shutdown status, the time interval between the current moment and the preset moment at which work is started is calculated in real time; and it is determined whether the time interval is less than or equal to the maximum early start duration.

The maximum early start duration may be set reasonably.

At the step of S200, if the time interval is less than or equal to the maximum early start duration, a preparatory demand load corresponding to the central air conditioner is acquired, and a startup combination load corresponding to the central air conditioner is acquired.

If the time interval is less than or equal to the maximum early start duration, the preparatory demand load corresponding to the central air conditioner is acquired, and the startup combination load corresponding to the central air conditioner is acquired.

It would be understood that the preparatory demand load is determined according to the indoor unit in a working scenario corresponding to the moment at which work is started, i.e., a demand load corresponding to the indoor unit that needs to be started at the moment at which work is started; and the startup combination load is determined according to the preparatory demand load.

At the step of S300, a start moment of a host to be started is determined on the basis of the startup combination load and the preparatory demand load.

In these embodiments, when the startup combination load and the preparatory demand load are acquired, the host to be started is determined according to the startup combination load and the preparatory demand load; and the start moment of the host to be started is determined according to the startup combination load.

In some examples, after the step of S300, the air conditioner control method further includes: starting the host to be started and the indoor unit corresponding to the preset moment at which work is started, when the current moment reaches the start moment.

In these embodiments, the host to be started and the indoor unit corresponding to the preset moment at which work is started in the central air conditioner are started in advance according to the start moment, thereby realizing precooling or preheating for a room corresponding to the preset moment at which work is started, thus reducing energy consumption and guaranteeing comfortability in rooms corresponding to the moment at which work is started, so that the accuracy of precooling or preheating by the central air conditioner is improved.

The air conditioner control method provided by these embodiments determines whether the time interval between the current moment and the preset moment at which work is started is less than or equal to the maximum early start duration; acquires the preparatory demand load corresponding to the central air conditioner and acquires the startup combination load corresponding to the central air conditioner, if the time interval is less than or equal to the maximum early start duration; and determines the start moment of the host to be started on the basis of the startup combination load and the preparatory demand load, such that the start moment of the host in the central air conditioner can be determined according to the preparatory demand load, which is convenient for subsequent starting the central air conditioner in advance according to the start moment, thus reducing energy consumption and guaranteeing comfortability in rooms corresponding to the moment at which work is started, so that the accuracy of precooling or preheating by the central air conditioner is improved.

Based on the first embodiments, there is provided some second embodiments of the air conditioner control method according to the present disclosure. In these embodiments, the step of S200 includes steps of S210 to S220.

At the step of S210, an outdoor wet-bulb temperature, an indoor temperature and a return water temperature corresponding to the central air conditioner are acquired.

At the step of S220, the preparatory demand load is determined on a basis of an indoor set temperature corresponding to the central air conditioner, the outdoor wet-bulb temperature, the indoor temperature and the return water temperature.

In these embodiments, if the time interval is less than or equal to the maximum early start duration, the outdoor wet-bulb temperature, the indoor temperature and the return water temperature corresponding to the central air conditioner are acquired. The outdoor wet-bulb temperature is a wet-bulb temperature of a cooling tower corresponding to the central air conditioner at the current moment, and the indoor temperature may be an indoor temperature of the environment where the central air conditioner is located. For example, the indoor temperature is an average value of the temperatures in the room corresponding to the preset moment at which work is started.

Subsequently, the preparatory demand load is determined on the basis of the indoor set temperature corresponding to the central air conditioner, the outdoor wet-bulb temperature, the indoor temperature and the return water temperature. The central air conditioner stores a mapping relationship between the outdoor wet-bulb temperature, the indoor temperature, the return water temperature and the demand load. The preparatory demand load is determined according to the mapping relationship.

It would be understood that the central air conditioner can record its historical operation data from historical big data. The historical operation data includes a historical demand load (such as a current operation load) of the central air conditioner corresponding to the indoor set temperature, the outdoor wet-bulb temperature, the indoor temperature and the return water temperature, and the mapping relationship between the outdoor wet-bulb temperature, the indoor temperature, the return water temperature and the demand load is determined according to the historical big data.

In some embodiments, the indoor set temperature includes a plurality of set temperature values, the outdoor wet-bulb temperature includes a plurality of wet-bulb temperature values, the indoor temperature includes a plurality of indoor temperature values, and the return water temperature includes a plurality of return water temperature values. An average demand load of historical demand loads corresponding to same set temperature values, same wet-bulb temperature values, same indoor temperature values and same return water temperature values in the big data is taken as the demand load corresponding to the same set temperature values, the same wet-bulb temperature values, the same indoor temperature values and the same return water temperature values, thus obtaining the mapping relationship between the outdoor wet-bulb temperature, the indoor temperature, the return water temperature and the demand load.

In some embodiments, the same set temperature values, the same wet-bulb temperature values, the same indoor temperature values and the same return water temperature values in the big data correspond to a plurality of the historical demand loads, and the number of the indoor units that are in the operating status and correspond to the plurality of the historical demand loads is not exactly same. The average demand load of the historical demand loads corresponding to the same number of the indoor units, the same set temperature values, the same wet-bulb temperature values, the same indoor temperature values and the same return water temperature values in the big data is taken as the demand load corresponding to the same number of the indoor units, the same set temperature values, the same wet-bulb temperature values, the same indoor temperature values and the same return water temperature values, thus obtaining the mapping relationship between the number of the indoor units, the outdoor wet-bulb temperature, the indoor temperature, the return water temperature, and the demand load. In determination of the preparatory demand load, the number of the indoor units to be started corresponding to the preset moment at which work is started is determined, and the corresponding preparatory demand load is queried according to the above mapping relationship based on the acquired number of the indoor units to be started, the indoor set temperature, the outdoor wet-bulb temperature, the indoor temperature, and the return water temperature.

The air conditioner control method provided by these embodiments acquires the outdoor wet-bulb temperature, the indoor temperature and the return water temperature corresponding to the central air conditioner; and determines the preparatory demand load on the basis of the indoor set temperature corresponding to the central air conditioner, the outdoor wet-bulb temperature, the indoor temperature and the return water temperature, such that the preparatory demand load can be accurately determined according to the outdoor wet-bulb temperature, the indoor temperature and the return water temperature, thus improving the accuracy of the preparatory demand load, and further improving the accuracy of determining the start moment according to the preparatory demand load.

Based on the second embodiments, there is provided some third embodiments of the air conditioner control method according to the present disclosure. In these embodiments, the step of S200 includes steps of S230 to S240.

At the step of S230, the host to be started corresponding to the central air conditioner is determined on a basis of the preparatory demand load.

At the step of S240, the startup combination load is determined on a basis of the host to be started.

In these embodiments, the host to be started corresponding to the central air conditioner is determined on the basis of the preparatory demand load. The host to be started is a combination of hosts with suitable cooling capacity and the highest energy efficiency that meet the demand for startup on that day. The startup combination load is then determined according to the host to be started.

In some embodiments, the step of S240 includes steps of a and b.

At the step of a, an outlet water temperature corresponding to the host to be started is acquired.

At the step of b, the startup combination load is determined on a basis of an operation parameter of the host to be started, the outlet water temperature and the outdoor wet-bulb temperature.

In these embodiments, the central air conditioner stores a mapping relationship between the operation parameter of the host to be started, the outlet water temperature, the outdoor wet-bulb temperature, and the startup combination load. The startup combination load is determined according to the mapping relationship.

It would be understood that the central air conditioner can record its historical operation data from historical big data. The historical operation data includes the mapping relationship between the operation parameter of the host to be started, the outlet water temperature, the outdoor wet-bulb temperature, and the startup combination load. The operation parameter of the host to be started includes gross power when the host to be started is started.

In some embodiments, the operation parameter includes a plurality of parameter ranges, the outdoor wet-bulb temperature includes a plurality of wet-bulb temperature values, and the outlet water temperature includes a plurality of outlet water temperature values. An average combination load of historical combination loads corresponding to same parameter ranges, same wet-bulb temperature values, and same outlet water temperature values in big data is taken as the combination load corresponding to the same parameter ranges, the same wet-bulb temperature values, and the same outlet water temperature values, thus obtaining the mapping relationship between the operation parameter of the host to be started, the outlet water temperature, the outdoor wet-bulb temperature and the startup combination load.

In some embodiments, the same parameter ranges, the same wet-bulb temperature values, and the same outlet water temperature values in the big data correspond to a plurality of the historical combination loads, and the number of the indoor units that are in the operating status and correspond to the plurality of the historical combination loads is not exactly same. The historical combination loads corresponding to the same number of the indoor units, the same parameter ranges, the same wet-bulb temperature values, and the same outlet water temperature values in the big data is taken as the combination load which corresponds to the historical combination loads corresponding to the same parameter ranges, the same wet-bulb temperature values, and the same outlet water temperature values, thus obtaining the mapping relationship between the number of the indoor units, the same parameter ranges, the same wet-bulb temperature values, the same outlet water temperature values, and the demand load. In determination of the startup combination load, the corresponding startup combination load is queried according to the above mapping relationship based on the number of the host to be started, the operation parameter of the host to be started, the outlet water temperature, and the outdoor wet-bulb temperature.

The air conditioner control method provided by these embodiments determines the host to be started corresponding to the central air conditioner based on the preparatory demand load, and determines the startup combination load based on the host to be started, such that the startup combination load can be accurately determined according to the preparatory demand load, thus improving the accuracy of the startup combination load, and further improving the accuracy of the start moment.

Based on the first embodiments, there is provided some fourth embodiments of the air conditioner control method according to the present disclosure. In these embodiments, the step of S300 includes steps of S310 to S320.

At the step of S310, a start operation duration is calculated on a basis of the startup combination load and the preparatory demand load.

At the step of S320, the start moment of the host to be started is determined on a basis of the start operation duration.

In these embodiments, when the startup combination load and the preparatory demand load are acquired, the start operation duration is firstly calculated on the basis of the startup combination load and the preparatory demand load, where the start operation duration=the preparatory demand load/the startup combination load; and the start moment of the host to be started is then determined on the basis of the start operation duration, that is the start moment is the preset moment at which work is started minus the start operation duration.

The air conditioner control method provided in these embodiments calculates the start operation duration based on the startup combination load and the preparatory demand load, and determines the start moment of the host to be started based on the start operation duration, such that the start moment of the host to be started can be accurately determined, which is convenient for subsequent starting the central air conditioner in advance according to the start moment, thus reducing energy consumption and guaranteeing comfortability in rooms corresponding to the moment at which work is started, so that the accuracy of precooling or preheating by the central air conditioner is improved.

Based on the first embodiments, there is provided some fifth embodiments of the air conditioner control method according to the present disclosure. In these embodiments, the air conditioner control method further includes steps of S400 to S600.

At the step of S400, a predicted load of the central air conditioner at the current moment is acquired, when a startup instruction or a shutdown instruction corresponding to an indoor unit in the central air conditioner is detected.

In these embodiments, it is monitored in real time whether there is an indoor unit with a changed operating status at the current moment, i.e., an indoor unit receiving a startup instruction to perform startup operation or an indoor unit receiving a shutdown instruction to perform shutdown. If there is the indoor unit with the changed operating status at the current moment, it is determined that the startup instruction or the shutdown instruction corresponding to the indoor unit in the central air conditioner is detected. At this moment, the predicted load of the central air conditioner at the current moment is acquired.

It should be noted that the predicted load is predicted according to a parameter of the indoor unit that is currently in the startup operation status.

At the step of S500, it is determined whether the predicted load meets a change condition for an outdoor unit.

At the step of S600, if the predicted load meets the change condition for the outdoor unit, an operating status of the outdoor unit in the central air conditioner is adjusted on a basis of the predicted load.

In these embodiments, when the predicted load is acquired, it is determined whether the predicted load meets the change condition for the outdoor unit. In specific, whether the predicted load meets the change condition for the outdoor unit may be determined according to the load of the outdoor unit that is currently in the operating status; alternatively, whether the predicted load meets the change condition for the outdoor unit is determined according to the predicted load at the current moment and the predicted load of the central air conditioner at the current moment before the startup instruction or the shutdown instruction is detected.

Subsequently, if the predicted load meets the change condition for the outdoor unit, the operating status of the outdoor unit in the central air conditioner is adjusted on the basis of the predicted load. In specific, the outdoor unit is adjusted according to the predicted load, so that a rated load of the outdoor unit matches the predicted load, thus further maximizing energy saving under the premise of satisfying comfortability, with more stable control and faster speed, thereby providing the most efficient cooling supply under different load requirements.

In some examples, in some embodiments, the step of S400 includes steps of S410 to S450.

At the step of S410, an operation parameter corresponding to the indoor unit that is currently in the startup status in the central air conditioner is acquired. The operation parameter includes a rated cooling capacity of the indoor unit.

At the step of S420, a first total cooling capacity corresponding to the indoor units that are currently in the startup status is determined on a basis of the operation parameter.

At the step of S430, a second gross cooling capacity of all indoor units in the central air conditioner is acquired.

At the step of S440, a terminal startup ratio is determined on a basis of the first total cooling capacity and the second gross cooling capacity.

At the step of S450, the predicted load is determined on a basis of the terminal startup ratio and a preset gross load corresponding to the central air conditioner.

In these embodiments, it is monitored in real time whether there is an indoor unit with a changed operating status at the current moment, i.e., an indoor unit receiving a startup instruction to perform startup operation or an indoor unit receiving a shutdown instruction to perform shutdown. If there is the indoor unit with the changed operating status at the current moment, the indoor unit that is currently in the startup status in the central air conditioner is firstly determine, where the indoor unit that is in the startup status does not include the indoor unit receiving the shutdown instruction; and the operation parameter corresponding to the indoor unit that is in the startup status is acquired.

When the operation parameter corresponding to the indoor unit that is in the startup status is acquired, the first total cooling capacity corresponding to the indoor units that are currently in the startup status is determined on the basis of the operation parameter, where the first total cooling capacity is a sum of rated cooling capacities of individual indoor units that are in the startup status; and then the second gross cooling capacity of all indoor units in the central air conditioner is acquired, where the second gross cooling capacity is a sum of rated cooling capacities of all indoor units in the central air conditioner.

Next, the terminal startup ratio is determined on the basis of the first total cooling capacity and the second gross cooling capacity. The terminal startup ratio equals to the first total cooling capacity/the second gross cooling capacity. In other embodiments, if individual rated cooling capacities of all terminals (i.e., all indoor units in the central air conditioner) are substantially identical, the terminal startup ratio equals to the number of the indoor units that are in the startup status/the number of all indoor units in the central air conditioner.

Subsequently, the predicted load is determined on the basis of the terminal startup ratio and the preset gross load corresponding to the central air conditioner. The preset gross load is a load of the central air conditioner obtained through historical big data when almost all terminals are in the startup status during normal working hours. The predicted load equals to the terminal startup ratio*the preset gross load.

In some examples, in other embodiments, the step of S400 includes steps of S460 to S480.

At the step of S460, a total load corresponding to the outdoor units that are in the startup status in the central air conditioner and a preset gross load corresponding to all outdoor units in the central air conditioner are acquired.

At the step of S470, a load difference between the predicted load and the total load is calculated, and a ratio of the load difference to the preset gross load is also calculated.

At the step of S480, it is determined whether the ratio is greater than a preset value. When the ratio is greater than the preset value, it is determined that the predicted load meets the change condition for the outdoor unit.

In these embodiments, the total load corresponding to the outdoor units that are in the startup status in the central air conditioner and the preset gross load corresponding to all outdoor units in the central air conditioner are acquired, where the total load is a sum of loads of the outdoor units that are in the startup status, and the preset gross load is a load of the central air conditioner obtained through historical big data when almost all terminals are in the startup status during normal working hours.

Subsequently, the load difference between the predicted load and the total load is calculated, and the ratio of the load difference to the preset gross load is also calculated; it is determined whether the ratio is greater than the preset value, and it is determined that the predicted load meets the change condition for the outdoor unit when the ratio is greater than the preset value.

In some examples, in other embodiments, the step of S600 includes steps of S610 to S620.

At the step of S610, an efficient outdoor unit combination is determined on a basis of the predicted load.

At the step of S620, the operating status of the outdoor unit in the central air conditioner is adjusted on a basis of the efficient outdoor unit combination.

In these embodiments, when the predicted load meets the change condition for the outdoor unit, the efficient outdoor unit combination is determined on the basis of the predicted load, where the total load of all outdoor units in the efficient outdoor unit combination is greater than the predicted load. In some examples, a range of the total load of all outdoor units in the efficient outdoor unit combination may be set between the predicted load*1.2 and the predicted load*1.5. Subsequently, the operating status of the outdoor unit in the central air conditioner is adjusted on the basis of the efficient outdoor unit combination, thereby accurately adjusting the operating status of the outdoor unit.

In some embodiments, the step of S620 includes steps of S621 to S622.

At the step of S621, if there is a first outdoor unit being in the shutdown status in the efficient outdoor unit combination, the first outdoor unit is started.

At the step of S622, if there is a second outdoor unit, which does not belong to the efficient outdoor unit combination, in the outdoor units that are in the startup status in the central air conditioner, the second outdoor unit is shut down.

In these embodiments, the first outdoor unit that is in the shutdown status in the efficient outdoor unit combination is started; and the second outdoor unit, which does not belong to the efficient outdoor unit combination, in the outdoor units that are in the startup status in the central air conditioner, the second outdoor unit is shut down, thereby accurately adjusting the operating status of the outdoor unit.

After the step of S620, the step of S600 further includes: controlling a valve and a water pump in the central air conditioner on a basis of the efficient outdoor unit combination; determining an efficient cooling tower combination on a basis of the predicted load; and adjusting an operating status of the cooling tower in the central air conditioner on a basis of the cooling tower combination.

In these embodiments, the valve and the water pump in the central air conditioner are adjusted, thus accurately adjusting a refrigerant system corresponding to the outdoor unit, thereby improving the accuracy of control of the central air conditioner. The efficient cooling tower combination is determined on the basis of a refrigerant flow range corresponding to the predicted load, and the operating status of the cooling tower in the central air conditioner is adjusted on the basis of the cooling tower combination, so that the refrigerant flow that can be cooled by the efficient cooling tower combination matches the predicted load, thereby improving the accuracy of control of the central air conditioner.

The air conditioner control method provided in these embodiments acquires the predicted load of the central air conditioner at the current moment when the startup instruction or the shutdown instruction corresponding to the indoor unit in the central air conditioner is detected, determines whether the predicted load meets the change condition for the outdoor unit, and adjusts the operating status of the outdoor unit in the central air conditioner based on the predicted load, if the predicted load meets the change condition for the outdoor unit, such that the host of the central air conditioner can be adjusted in time according to the predicted load, thus maximizing energy saving under the premise of satisfying comfortability, reducing power consumption of the central air conditioner, improving stability and speed of control of the central air conditioner, and providing the most efficient cooling supply by timely adjustment of the outdoor unit under different load requirements.

In addition, the present disclosure provides in embodiments a computer-readable storage medium having stored therein an air conditioner control program that, when executed by a processor, implements the following steps:

determining whether a time interval between a current moment and a preset moment at which work is started is less than or equal to a maximum early start duration;

acquiring a preparatory demand load corresponding to the central air conditioner and acquiring a startup combination load corresponding to the central air conditioner, if the time interval is less than or equal to the maximum early start duration; and determining a start moment of a host to be started on a basis of the startup combination load and the preparatory demand load.

In some examples, the air conditioner control program when executed by the process implements the following steps:

acquiring an outdoor wet-bulb temperature, an indoor temperature and a return water temperature corresponding to the central air conditioner; and determining the preparatory demand load based on an indoor set temperature corresponding to the central air conditioner, the outdoor wet-bulb temperature, the indoor temperature and the return water temperature.

In some examples, the air conditioner control program when executed by the process implements the following steps:

determining the host to be started corresponding to the central air conditioner based on the preparatory demand load; and determining the startup combination load based on the host to be started.

In some examples, the air conditioner control program when executed by the process implements the following steps:

acquiring an outlet water temperature corresponding to the host to be started; and determining the startup combination load based on an operation parameter of the host to be started, the outlet water temperature and the outdoor wet-bulb temperature.

In some examples, the air conditioner control program when executed by the process implements the following steps:

calculating a start operation duration based on the startup combination load and the preparatory demand load; and determining the start moment of the host to be started based on the start operation duration.

In some examples, the air conditioner control program when executed by the process implements the following steps:

acquiring a predicted load of the central air conditioner at the current moment, when a startup instruction or a shutdown instruction corresponding to an indoor unit in the central air conditioner is detected;

determining whether the predicted load meets a change condition for an outdoor unit; and adjusting an operating status of the outdoor unit in the central air conditioner based on the predicted load, if the predicted load meets the change condition for the outdoor unit.

In some examples, the air conditioner control program when executed by the process implements the following steps:

acquiring an operation parameter corresponding to the indoor unit that is currently in the startup status in the central air conditioner, the operation parameter including a rated cooling capacity of the indoor unit;

determining a first total cooling capacity corresponding to the indoor units that are currently in the startup status based on the operation parameter;

acquiring a second gross cooling capacity of all indoor units in the central air conditioner;

determining a terminal startup ratio based on the first total cooling capacity and the second gross cooling capacity; and determining the predicted load based on the terminal startup ratio and a preset gross load corresponding to the central air conditioner.

In some examples, the air conditioner control program when executed by the process implements the following step:

starting the host to be started and the indoor unit corresponding to the preset moment at which work is started, when the current moment reaches the start moment.

It should be noted that the terms "comprise", "include" or any other variants thereof used herein are intended to cover non-exclusive inclusion, so that a process, method, article or system including a series of elements not only includes those specified elements, but also includes other elements that are not explicitly listed, or also includes elements inherent to the process, method, article or system. Without more restrictions, an element defined by the sentence "comprising/including a . . . " does not exclude the existence of other identical elements involved in the process, method, article or system that includes the element.

The serial numbers of the foregoing embodiments of the present disclosure are only for description, but do not represent superiority or inferiority of the embodiments.

Through the description of the above embodiments, those skilled in the art can clearly understand that the method in the above embodiments can be implemented by means of software plus the necessary general hardware platform, or by hardware, where the former is better embodiments. Based on this understanding, the technical solution of the present disclosure can be essentially or the partly that contributes to the prior art embodied in the form of a software product The computer software product is stored in a storage medium (such as ROM/RAM, magnetic disk, optical disk) as described above, including several instructions to make a terminal device (which may be a mobile phone, a computer, a server, an air conditioner, or a network device, etc.) implement the method described in individual embodiments of the present disclosure.

The above are only preferred embodiments of the present disclosure, but do not limit the scope of the present disclosure. Any equivalent structure or equivalent process transformation made based on the description and drawings of the present disclosure, or directly or indirectly used in other related technical fields, is included in the protection scope of the present disclosure for the similar reason.

What is claimed is:

1. An air conditioner control method, applied in a central air conditioner comprising an indoor unit and a plurality of outdoor units, the air conditioner control method comprising:

determining a time interval between a current moment and a preset moment at which work is started is less than or equal to a predetermined maximum time duration;

in response to determining that the time interval is less than or equal to the predetermined maximum time duration, acquiring a preparatory demand load and a startup combination load corresponding to the central air conditioner;

determining a start moment of at least one of the plurality of outdoor units to be started on a basis of the startup combination load and the preparatory demand load;

detecting a startup instruction or a shutdown instruction;

in response to detecting a startup instruction or a shutdown instruction corresponding to an indoor unit in the central air conditioner, acquiring a predicted load of the central air conditioner at the current moment;

acquiring a total load corresponding to outdoor units that are in startup status in the central air conditioner and a preset gross load corresponding to all outdoor units in the central air conditioner;

determining a ratio based on the predicted load, total load and the preset gross load;

determining the ratio is greater than a preset value;

in response to determining that the ratio being greater than the preset value; and adjusting an operating status of the at least one of the plurality of outdoor units in the central air conditioner based on the predicted load.

2. The air conditioner control method according to claim 1, wherein acquiring the preparatory demand load corresponding to the central air conditioner comprises:

acquiring an outdoor wet-bulb temperature, an indoor temperature and a return water temperature corresponding to the central air conditioner; and determining the preparatory demand load based on an indoor set temperature corresponding to the central air conditioner, the outdoor wet-bulb temperature, the indoor temperature and the return water temperature.

3. The air conditioner control method according to claim 2, wherein acquiring the startup combination load corresponding to the central air conditioner comprises:

determining the at least one of the plurality of outdoor units to be started corresponding to the central air conditioner based on the preparatory demand load; and determining the startup combination load based on the at least one of the plurality of outdoor units to be started.

4. The air conditioner control method according to claim 3, wherein determining the startup combination load based on the outdoor unit to be started comprises:

acquiring an outlet water temperature corresponding to the outdoor unit to be started; and determining the startup combination load based on an operation parameter of the outdoor unit to be started, the outlet water temperature and the outdoor wet-bulb temperature.

5. The air conditioner control method according to claim 1, wherein determining the start moment of the at least one of the plurality of outdoor units to be started based on the startup combination load and the preparatory demand load comprises:

calculating a start operation duration based on the startup combination load and the preparatory demand load; and determining the start moment of the at least one of the plurality of outdoor units to be started based on the start operation duration.

6. The air conditioner control method according to claim 1, wherein acquiring a predicted load of the central air conditioner at the current moment comprises:

acquiring an operation parameter corresponding to the indoor unit that is currently in a startup status in the central air conditioner, the operation parameter comprising a rated cooling capacity of the indoor unit;

determining a first total cooling capacity corresponding to indoor units that are currently in the startup status based on the operation parameter;

acquiring a second gross cooling capacity of all indoor units in the central air conditioner;

determining a terminal startup ratio based on the first total cooling capacity and the second gross cooling capacity; and determining the predicted load based on the terminal startup ratio and a preset gross load corresponding to the central air conditioner.

7. The air conditioner control method according to claim 1, further comprising:

after determining the start moment of the at least one of the plurality of outdoor units to be started based on the startup combination load and the preparatory demand load;

in response to a determination that the current moment corresponds to the start moment, starting the at least one of the plurality of outdoor units to be started and an indoor unit corresponding to the preset moment at which work is started.

8. An air conditioner control apparatus, applied in a central air conditioner, wherein the air conditioner control apparatus comprises: a memory, a processor, and an air conditioner control program stored in the memory and executable by the processor, wherein the air conditioner control program when executed by the processor implements steps of an air conditioner control method according to claim 1.

9. The air conditioner control method according to claim 1, wherein adjusting an operating status of the at least one of the plurality of outdoor units in the central air conditioner based on the predicted load comprises matching a rated load of the at least one of the plurality of outdoor units to the predicted load.

10. The air conditioner control method according to claim 1, further comprising determining an efficient outdoor unit combination based on the predicted load.

11. The air conditioner control method according to claim 10, further comprising:

controlling a valve and a water pump in the central air conditioner based on the efficient outdoor unit combination;

determining an efficient cooling tower combination based on the predicted load; and adjusting an operating status of the cooling tower in the central air conditioner based on the cooling tower combination.

12. The air conditioner control method according to claim 10, wherein the efficient cooling tower combination is determined based on a refrigerant flow range corresponding to the predicted load, and the operating status of the cooling tower in the central air conditioner is adjusted based on the cooling tower combination, to match the predicted load with a refrigerant flow that is cooled by the efficient cooling tower combination.

13. A non-transitory computer-readable storage medium storing one or more programs, the one or more programs comprising instructions, which, when executed by an electronic device with a display device, cause the electronic device to:

determining whether a time interval between a current moment and a preset moment is less than or equal to a predetermined maximum time duration;

in accordance with a determination that the time interval is less than or equal to the predetermined maximum time duration, acquiring a preparatory demand load corresponding to a central air conditioner comprising an indoor unit and a plurality of outdoor units and acquiring a startup combination load corresponding to the central air conditioner;

determining a start moment of at least one of the plurality of outdoor units to be started on a basis of the startup combination load and the preparatory demand load;

in response to detecting a startup instruction or a shutdown instruction corresponding to an indoor unit in the central air conditioner, acquiring a predicted load of the central air conditioner at the current moment; acquiring a total load corresponding to outdoor units that are in startup status in the central air conditioner and a preset gross load corresponding to all outdoor units in the central air conditioner;

determining a ratio based on the predicted load, total load and the preset gross load;

in response to determining that the ratio being greater than the preset value; and adjusting an operating status of the at least one of the plurality of outdoor units in the central air conditioner based on the predicted load.

* * * * *